US006769477B2

(12) United States Patent
Häkkinen et al.

(10) Patent No.: US 6,769,477 B2
(45) Date of Patent: Aug. 3, 2004

(54) SUPPLY AIR TERMINAL DEVICE

(75) Inventors: Marko Häkkinen, Kuusankoski (FI); Lasse Laurila, Kouvola (FI); Pekka Pulkkinen, Kausala (FI); Mika Ruponen, Lahti (FI); Reijo Villikka, Kausala (FI); Kari Äikäs, Kouvola (FI)

(73) Assignee: Halton Oy, Kausala (FI)

( * ) Notice: Subject to any disclaimer, the term of this patent is extended or adjusted under 35 U.S.C. 154(b) by 0 days.

(21) Appl. No.: 10/008,686

(22) Filed: Dec. 7, 2001

(65) Prior Publication Data

US 2002/0070010 A1 Jun. 13, 2002

(30) Foreign Application Priority Data

Dec. 7, 2000 (FI) ..... 20002677

(51) Int. Cl.[7] ..... F24F 1/01; F24F 3/06

(52) U.S. Cl. ..... 165/123; 165/53

(58) Field of Search ..... 165/123, 96, 53; 454/264

(56) References Cited

U.S. PATENT DOCUMENTS

| | | | | |
|---|---|---|---|---|
| 3,012,760 A | * | 12/1961 | McGrath | 165/123 |
| 3,183,968 A | * | 5/1965 | Jekat | 165/123 |
| 3,411,572 A | * | 11/1968 | Honnold, Jr. | 165/123 |
| 4,493,312 A | | 1/1985 | Moon | 126/299 |
| 5,577,958 A | | 11/1996 | Kumekawa et al. | 454/233 |

FOREIGN PATENT DOCUMENTS

| | | |
|---|---|---|
| DE | 1778188 | 11/1971 |
| DE | 3321612 | 12/1984 |
| DE | 29609754 U1 | 2/1997 |
| EP | 0774628 | 5/1997 |
| EP | 0967443 | 12/1999 |
| FI | 990362 | 2/1999 |
| GB | 1011742 | 12/1965 |
| GB | 1577039 | 10/1980 |
| GB | 2271175 | 4/1994 |
| GB | 2349688 | 11/2000 |

* cited by examiner

*Primary Examiner*—Leonard R Leo
(74) *Attorney, Agent, or Firm*—Steinberg & Raskin, P.C.

(57) ABSTRACT

The invention concerns a supply air terminal device (10), which includes a supply air chamber (11) and therein nozzles (12$a_1$, 12$a_2$ . . . ), through which supply air is conducted into an internal side chamber ($B_1$) of the device. In the device solution, the supply airflow ($L_1$) induces a circulated airflow, that is a secondary airflow ($L_2$), from the room space ($H_1$) to flow through a heat exchanger (13) of the device into the side chamber ($B_1$) to join the supply airflow ($L_1$). In the device solution, the combined airflow ($L_1$+$L_2$) of supply air and circulated air is made to flow sideways from the device. The central axes ($X_1$) of the nozzles (12$a_1$, 12$a_2$ . . . ) of the supply air chamber (11) are at an oblique angle ($\alpha$) in relation to the vertical axis ($y_1$) of the device, whereby the supply airflow from the supply air chamber (11) is conducted obliquely from the nozzles towards a wall (14) limiting the side chamber ($B_1$), whereby the combined airflow ($L_1$+$L_2$) of supply airflow ($L_1$) and circulated airflow ($L_2$) is conducted sideways from the device.

5 Claims, 4 Drawing Sheets

SUPPLY AIR TERMINAL DEVICE

FIELD OF THE INVENTION

The invention concerns a supply air terminal device, which is used for conducting a mixture of primary air and circulated air into the room space. The primary air, preferably fresh supply air, is first conducted into the supply air chamber of the device and thence through nozzles into a mixing chamber. The primary airflow is used to induce a secondary airflow, that is, a flow of re-circulated air, from the room space. In the device solution, the secondary airflow and the primary airflow are combined in the mixing chamber, and the combined airflow is made to flow away from the device.

BACKGROUND OF THE INVENTION

So-called closed and open state-of-the-art supply air terminal devices are known. The so-called closed supply air terminal device is open from the bottom part of the device, whereby the re-circulated airflow $L_2$ is conducted below through the heat exchanger of the device into the mixing chamber. The said airflow is induced by supply airflow $L_1$ from the nozzles of the supply air chamber. From the mixing chamber, the combined airflow $L_1+L_2$ is made to flow out and preferably sideways guided by flow-guiding plates.

Where the circulated airflow is cooled, directing of the airflow leaving the device has become a problem. In state-of-the-art solutions, the combined airflow $L_1+L_2$ tends to leave the device downwards, although the aim is to direct the combined airflow $L_1+L_2$ to the side horizontally and preferably at ceiling level.

OBJECTS AND SUMMARY OF THE INVENTION

In order to overcome the above-mentioned problem, in the solution according to the invention the supply airflow is directed from the nozzles of the supply air chamber in such a way that the flow meets obliquely an internal wall limiting the mixing chamber $B_1$, which wall is located close to the heat exchanger. Thus, the central axes of the nozzles are obliquely at an angle $\alpha$ in relation to the vertical axis $y_1$ of the device. The angle range $\alpha$ is preferably between 5° and 15°, that is, $5° \leqq \alpha \leqq 15°$. With the described directing of the nozzles a desired throw pattern is achieved for the combined airflow $L_1+L_2$.

BRIEF DESCRIPTION OF THE DRAWINGS

In the following, the invention will be described with reference to some advantageous embodiments of the invention shown in the figures of the appended drawings, but the intention is not to limit the invention to these embodiments only.

DETAILED DESCRIPTION OF THE INVENTION

Figure 1A:
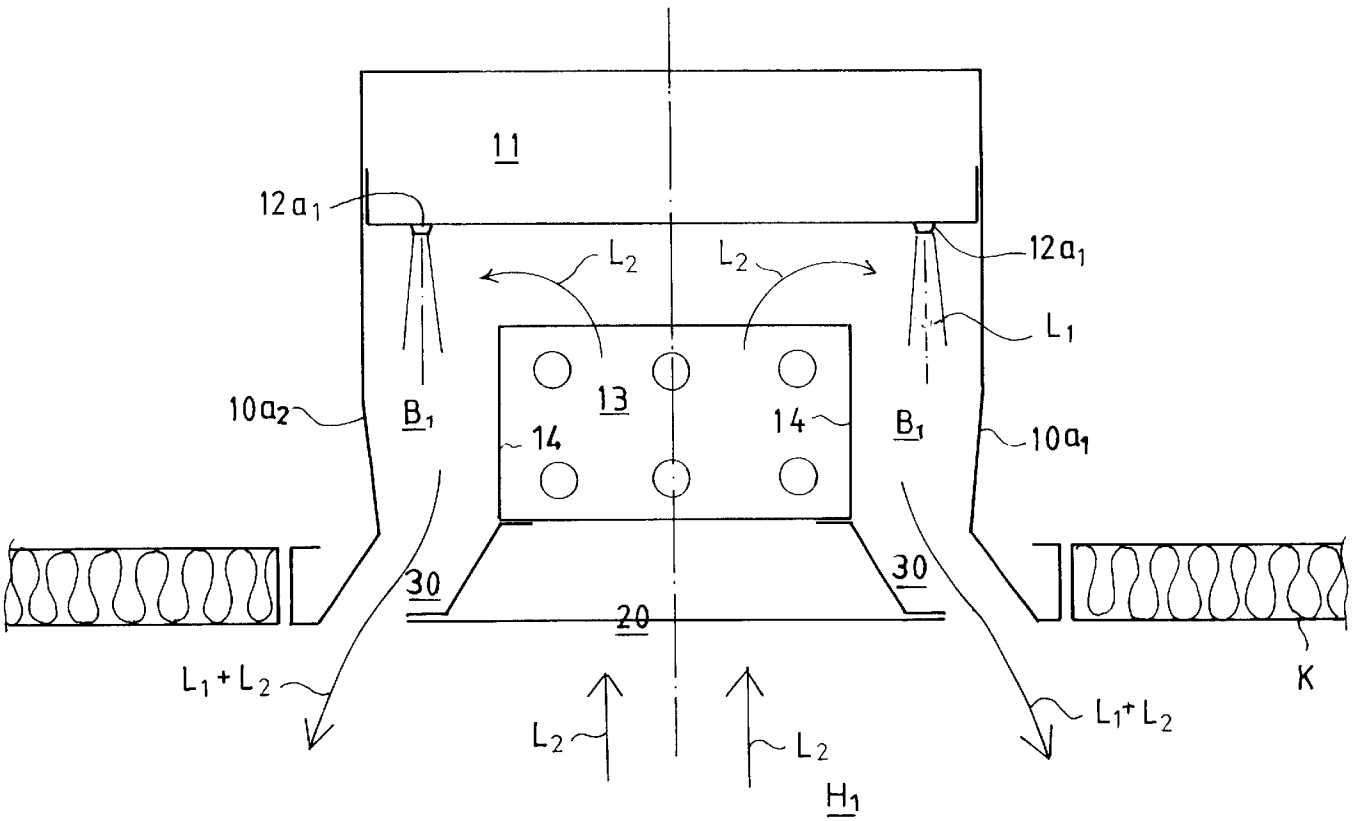
FIG. 1A is a cross-sectional view of a state-of-the-art device solution. The problem area occurring in the state-of-the-art solution is described based on the figure.

FIG. 1A shows a state-of-the-art supply air terminal device 10. From the supply air terminal device 10 fresh supply air is made to flow into a side chamber or mixing chamber $B_1$ from nozzles 12$a_1$, 12$a_2$ . . . The said airflow $L_1$ pulls along a circulated airflow $L_2$ from room space $H_1$ through heat exchanger 13. In heat exchanger 13 the said circulated air $L_2$ is either cooled or heated. In case of cooling it has become a problem that the combined airflow $L_1+L_2$ is in a direction downwards and not sideways from the device, as it should. In the embodiment shown in FIG. 1A, the nozzles 12$a_1$, 12$a_2$ . . . direct the supply airflow, that is, the primary airflow $L_1$, directly downwards. Hereby the combined airflow $L_1+L_2$ is also directed downwards from discharge opening 30.

Figure 1B:
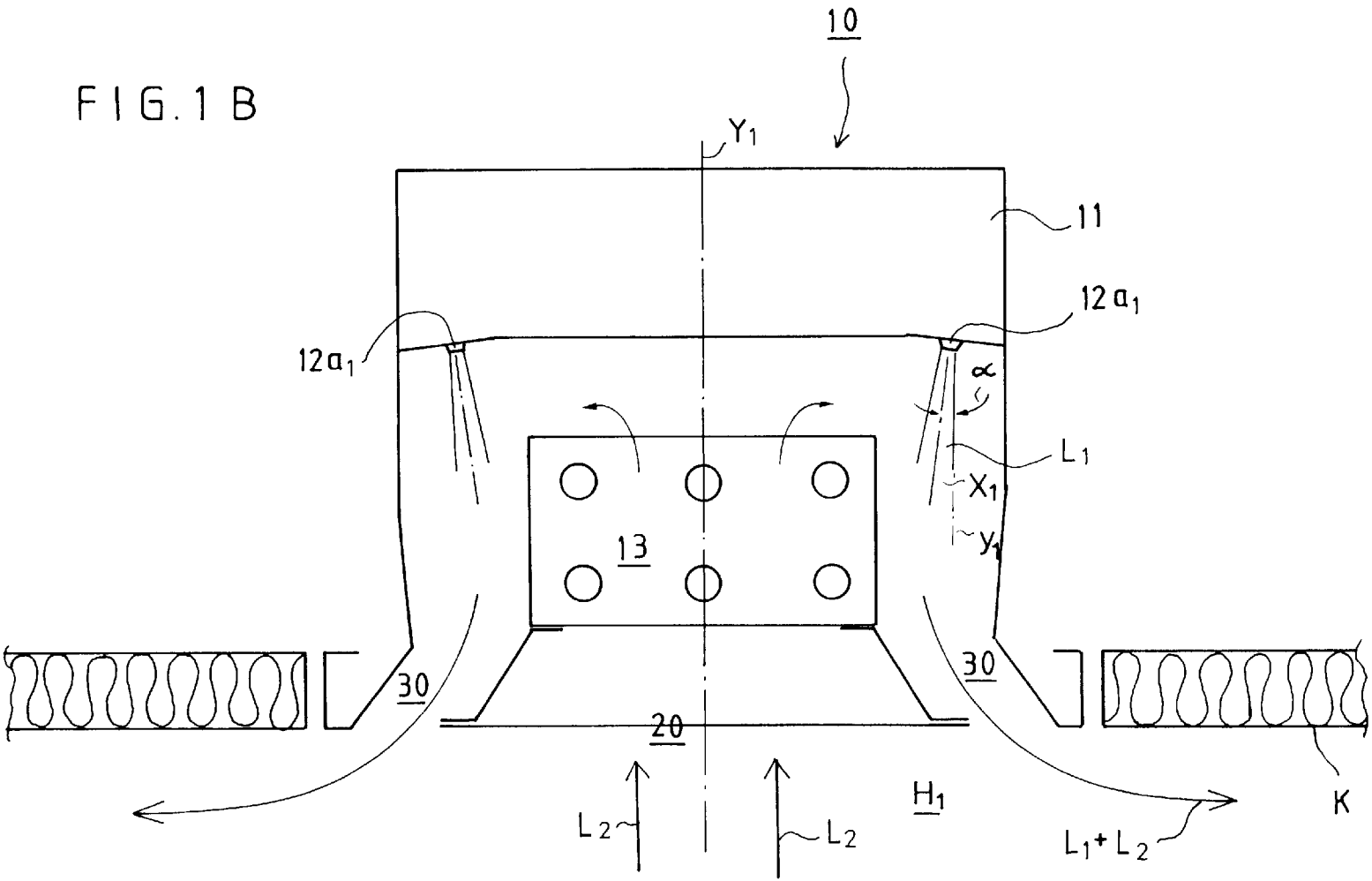
FIG. 1B shows a solution to the problem shown in FIG. 1A.

FIG. 1B shows a solution to the problem according to FIG. 1A. As is shown in the figure, the central axes $X_1$ of nozzles 12$a_1$, 12$a_2$ . . . are at an oblique angle $\alpha$ in relation to vertical axis $y_1$. Angle $\alpha$ is in a range of 5°–15°, that is, $5° \leqq \alpha \leqq 15°$. In the figures, the central vertical axis of the device is indicated by $Y_1$ and the parallel vertical axis is indicated by $y_1$. In addition, nozzles 12$a_1$, 12$a_2$ . . . are directed in such a way obliquely in relation to vertical axis $y_1$ that the air $L_1$made to flow from them into the mixing chamber is directed towards the central part of the device and obliquely towards wall 14, which wall 14 functions as one side wall of side chamber $B_1$. By the oblique mounting of nozzles 12$a_1$, 12$a_2$ . . . according to the invention the supply airflow $L_1$ is directed to flow in parallel with side wall 14, whereby the flow clings to side wall 14 and flows partly under the coanda effect along the surface of side wall 14 downwards, and guided by the said side wall structure it will leave the device through discharge opening 30. The supply airflow $L_1$ induces the circulated airflow $L_2$ to follow it and thus the combined airflow $L_1+L_2$ is made to flow out of the device sideways and horizontally.

Figure 2A:
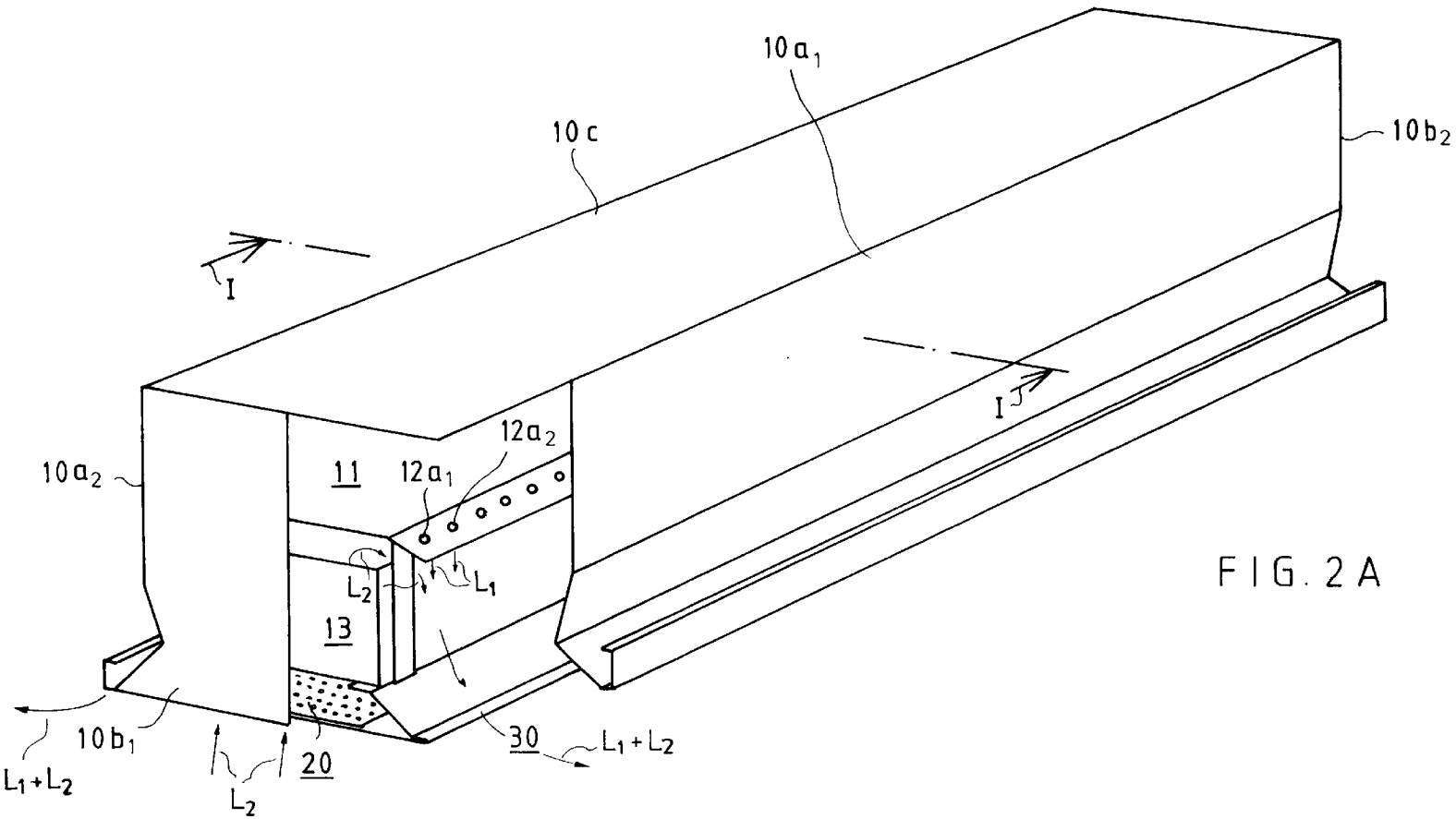
FIG. 2A is an axonometric view of the supply air terminal device according to the invention.

FIG. 2A is an axonometric view of the supply air terminal device according to the invention and it is cut open in part to show the internal components of the device. Supply air terminal device 10 is a so-called closed structure, whereby it includes flow paths into the device for the circulated airflow $L_2$ as the figure shows below the device and flow paths for the combined airflow $L_1+L_2$ leaving the device also below the device. The device includes side plates 10$a_1$, 10$a_2$ and end plates 10$b_1$, 10$b_2$ as well as a covering plate 10$c$. Plate 10$c$ limits the supply air chamber 11 at the top. The air is conducted from the supply air channel (not shown) into supply air chamber 11. From supply air chamber 11 the air is made to flow as the arrows $L_1$ indicate through nozzles 12$a_1$, 12$a_2$ . . . into side chamber or mixing chamber $B_1$. The device is symmetrical in relation to the central vertical axis $Y_1$. There are two side chambers $B_1$, and the combined airflow $L_1+L_2$ is discharged to two sides from the device.

Figure 2B:
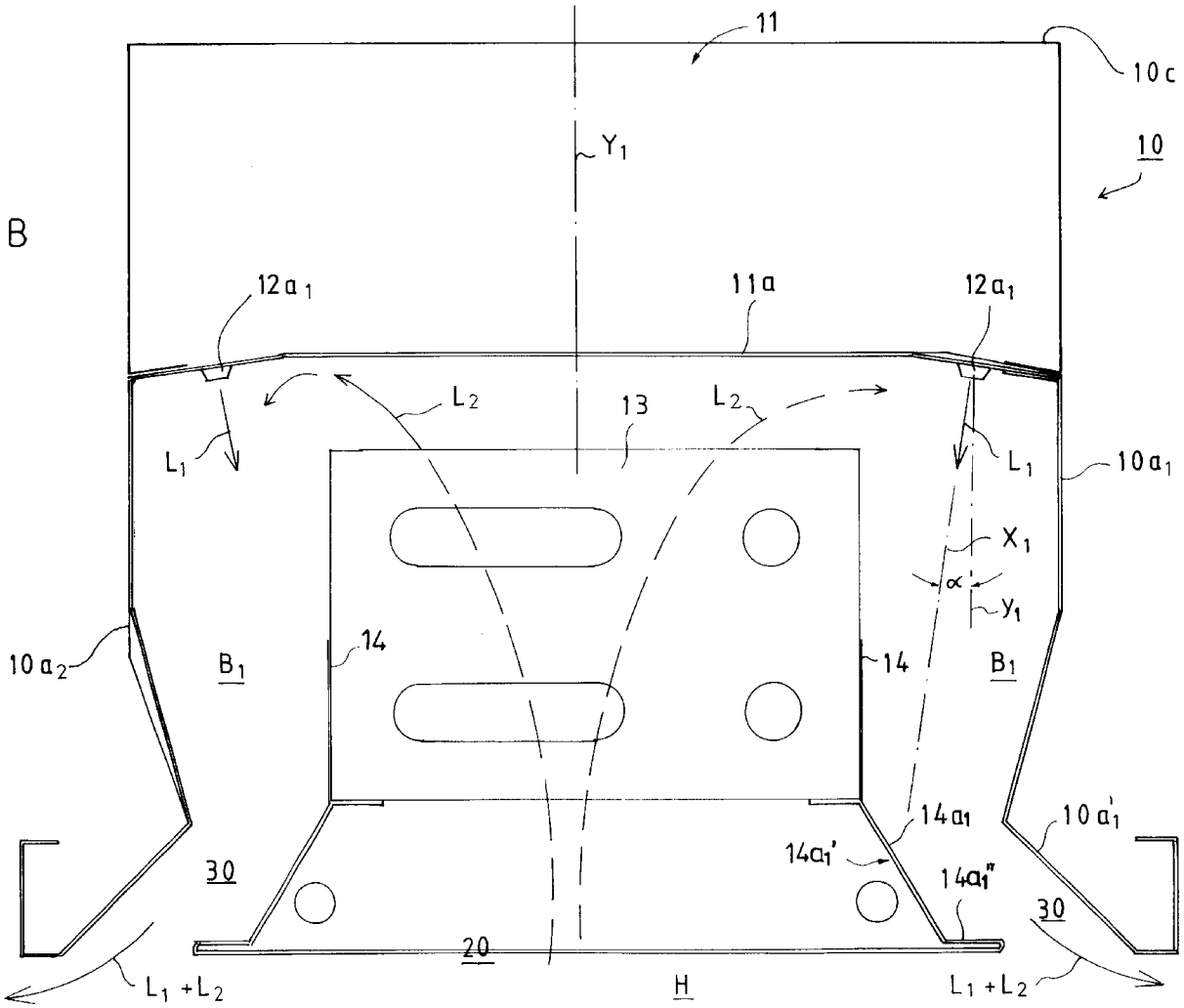
FIG. 2B is a cross-section along line I—I of FIG. 1A.

As is shown in FIG. 2B, the supply airflow $L_1$ is conducted from supply air chamber 11 through nozzles 12$a_1$, 12$a_2$ . . . in such a way that the supply airflow $L_1$ is directed towards the vertical central axis $Y_1$ of the device and thus towards the inner wall 14 of side chamber $B_1$. As is shown in the figure, each side chamber $B_1$ is limited by a wall 14 beside heat exchanger 13, by a side wall 10$b_1$ and at the top by the bottom 11$a$ of supply air chamber 11. In addition, each side chamber $B_1$ is limited at the ends by end plates 10$b_2$, 10$b_2$. The circulated airflow, that is, the secondary airflow $L_2$, travels induced by the primary airflow, that is, by the supply airflow $L_1$, from room space $H_1$ through a central supply opening 20 and through heat exchanger 13 to join the supply airflow $L_1$ in side chamber $B_1$. Flows $L_1+L_2$ are combined in side chamber $B_1$, and the combined airflow $L_1+L_2$ leaves side chamber $B_1$ guided by the lower guiding flap 14$a_1$ of wall 14 and by wall section 10$a_1$' located obliquely in relation to the lower vertical axis $Y_1$ of side plate 10$a_1$. Thus, the combined airflow $L_1+L_2$ is made to flow sideways from the device in the direction of ceiling K level. The device structure is symmetrical in relation to vertical central axis $Y_1$, and the airflow arrangement is similar at the other side of the device.

According to the invention, a heat exchanger 13 is used to heat or cool the circulated airflow $L_2$. If the circulated airflow $L_2$ is heated, heat is transferred from the heat transfer material of heat exchanger 13 into the circulated airflow $L_2$, and if heated, the heat energy is transferred from the circulated airflow into the heat transfer material and away from the device.

With the aid of walls 14 the device is divided into two structural sections; into a first central section, wherein heat exchanger 13 is located, and into two other sections, wherein a side or mixing chamber $B_1$ is formed. The circulated airflow $L_2$ is conducted through the supply opening 20 of the first central section to the central heat exchanger 13 of the device and from heat exchanger 13 into side chamber $B_1$. The supply airflow $L_1$ is conducted into side chamber $B_1$ from supply air chamber 11 through its nozzles 12$a_1$, 12$a_2$ . . . The airflows $L_1$ and $L_2$ are combined in side chamber $B_1$. Thus, the separating wall 14 functions both as a structure supporting and mounting the heat exchanger and also as a dividing structural component, which is used to direct the circulated airflow $L_2$ first through heat exchanger 13 and to separate side chamber $B_1$ from the remaining structure. According to the invention, the supply airflow $L_1$ is directed obliquely towards wall 14. The said direction is advantageous for the flow $L_1+L_2$ leaving the device. The combined airflow $L_1+L_2$ can be directed sideways away from the supply air terminal device 10.

In the internal wall 14 limiting side chamber $B_1$ the device according to the invention includes a guiding flap 14$a_1$, which includes a flap section 14$a_1$', which is positioned obliquely in relation to vertical axis $y_1$. With flap section 14$a_1$' an end flap section 14$a_1$" is joined, which is at right angles to vertical axis $y_1$. With the aid of the mentioned flow-guiding structure, the combined airflow $L_1+L_2$ is directed sideways from the device 10 through discharge opening 30.

As is shown in the figure, the central axes $X_1$ of nozzles 12$a_1$, 12$a_2$ . . . are directed in such a way that the angle $\alpha$ between the central axis $X_1$ of the nozzles and the vertical axis $y_1$ is in a range of 5°–15°, that is, $5° \leqq \alpha \leqq 15°$, and the said central axis $X_1$ is directed towards the central wall 14, the so-called separating wall 14, of side chamber $B_1$. Hereby the supply airflow $L_1$ from nozzles 12$a_1$, 12$a_2$ . . . is directed obliquely towards wall 14, and the combined airflow $L_1+L_2$ is directed horizontally sideways from the device.

We claim:

1. Supply air terminal device (10), comprising:

a supply air chamber (11) and therein nozzles (12$a_1$, 12$a_2$. . . ), through which supply air is conducted into an internal side chamber ($B_1$) of the device, and the supply airflow ($L_1$) induces a circulated or secondary airflow ($L_2$) from a room space ($H_1$) to flow through a heat exchanger (13) of the device into the side chamber ($B_1$) to join the supply airflow ($L_1$), and the combined airflow ($L_1+L_2$) of supply air and circulated air is made to flow sideways from the device, wherein the nozzles (12$a_1$, 12$a_2$. . . ) of the supply air chamber (11) have central axes ($X_1$), which are at an oblique angle ($\alpha$) in relation to the vertical axis ($y_1$) of the device, whereby the supply airflow from the supply air chamber (11) is conducted obliquely from the nozzles towards an internal wall (14) limiting the side chamber ($B_1$), whereby the combined airflow ($L_1+L_2$) of supply airflow ($L_1$) and circulated airflow ($L_2$) is conducted sideways from the device; and wherein the supply air chamber (11) is located in between side plates (10$a_1$, 10$a_2$) and that the device includes end plates (10$b_1$, 10$b_2$) and internal walls (14), in between which walls (14) the heat exchanger (13) is located, whereby the circulated airflow ($L_2$) flows between the walls (14) to the heat exchanger (13) and further into side chamber ($B_1$) between the side plate (10$a_1$) and the wall (14) induced by the supply airflow ($L_1$) conducted thereto.

2. Supply air terminal device according to claim 1, wherein the wall (14) includes a flap section (14$a_1$') and joined thereto an end flap section (14$a_1$"), whereby the flap section (14$a_1$') is in an oblique position in relation to vertical axis ($y_1$) and the end flap section (14$a_1$") is at right angles to vertical axis ($y_1$), whereby the above-mentioned structure functions to guide the combined airflow ($L_1+L_2$) sideways.

3. Supply air terminal device according to claim 1, wherein angle $\alpha$ is within a range of $5° \leqq \alpha \leqq 15°$.

4. A supply air terminal device according to claim 1, wherein the wall (14) includes a flap section (14$a_1$') having an end flap section (14$a_1$"), said end flap (14$a_1$") section being in an oblique position relative to the vertical axis ($y_1$) and said end flap section (14$a_1$") being at approximate right angles to the vertical axis ($y_1$) thereby guiding the combined airflow sideways.

5. Supply air terminal device (10), comprising:

a supply air chamber (11) and therein nozzles (12$a_1$, 12$a_2$. . . ), through which supply air is conducted into an internal side chamber ($B_1$) of the device, and the supply airflow ($L_1$) induces a circulated or secondary airflow ($L_2$) from a room space ($H_1$) to flow through a heat exchanger (13) of the device into the side chamber ($B_1$) to join the supply airflow ($L_1$), and the combined airflow ($L_1+L_2$) of supply air and circulated air is made to flow sideways from the device, wherein the nozzles (12$a_1$, 12$a_2$. . . ) of the supply air chamber (11) have central axes ($X_1$), which are at an oblique angle ($\alpha$) in relation to the vertical axis ($y_1$) of the device, whereby the supply airflow from the supply air chamber (11) is conducted obliquely from the nozzles towards an internal wall (14) limiting the side chamber ($B_1$), whereby the combined airflow ($L_1+L_2$) of supply airflow ($L_1$) and circulated airflow ($L_2$) is conducted sideways from the device; and a first side plate (10$a_1$), a second side plate (10$a_2$), a first end plate (10$b_1$), a second end plate (10$b_2$) and internal walls (14), said supply air chamber (11) disposed between said first side plate (10$a_1$) and said second side plate (10$a_2$) wherein the heat exchanger is arranged between said internal walls (14), whereby said circulated airflow ($L_2$) flows from between said walls (14) to said heat exchanger (13) and said circulated airflow ($L_2$) continues to flow into said side chamber ($B_1$) between one of said first side plates and a corresponding one of said internal walls (14) being exerted on by said supply airflow ($L_1$).

* * * * *